US009486659B2

(12) United States Patent
Chen

(10) Patent No.: US 9,486,659 B2
(45) Date of Patent: Nov. 8, 2016

(54) NOZZLE ASSEMBLY

(71) Applicant: Samuel Chen, Kowloon (CN)

(72) Inventor: Samuel Chen, Kowloon (CN)

( * ) Notice: Subject to any disclaimer, the term of this patent is extended or adjusted under 35 U.S.C. 154(b) by 314 days.

(21) Appl. No.: 13/720,556

(22) Filed: Dec. 19, 2012

(65) Prior Publication Data

US 2013/0109539 A1 May 2, 2013

Related U.S. Application Data

(63) Continuation-in-part of application No. 12/893,159, filed on Sep. 29, 2010, now Pat. No. 8,371,991.

(51) Int. Cl.

| | |
|---|---|
| ***A63B 5/11*** | (2006.01) |
| ***A63G 31/14*** | (2006.01) |
| ***A63B 71/06*** | (2006.01) |
| ***A63B 41/12*** | (2006.01) |
| ***A63G 31/12*** | (2006.01) |
| ***A63H 27/10*** | (2006.01) |
| ***A63B 21/02*** | (2006.01) |
| ***A63G 31/00*** | (2006.01) |
| ***A63B 41/00*** | (2006.01) |

(52) U.S. Cl.

CPC ..... *A63B 5/11* (2013.01); *A63B 41/12* (2013.01); *A63B 71/0619* (2013.01); *A63G 31/12* (2013.01); *A63G 31/14* (2013.01); *A63B 21/023* (2013.01); *A63B 41/00* (2013.01); *A63B 71/06* (2013.01); *A63B 71/0672* (2013.01); *A63B 2209/10* (2013.01); *A63B 2220/801* (2013.01); *A63B 2220/803* (2013.01); *A63B 2220/833* (2013.01); *A63B 2225/62* (2013.01); *A63G 31/007* (2013.01); *A63H 2027/1033* (2013.01); *A63H 2027/1041* (2013.01); *A63H 2027/1083* (2013.01)

(58) Field of Classification Search

CPC ..... A63H 27/10; A63H 27/1083; A63H 27/1033; A63H 2027/1041; A63H 2027/1083; A63H 2027/1033; A63B 5/11; A63B 2208/12; A63B 71/0619; A63B 41/12; A63B 21/023; A63B 2209/10; A63B 2220/833; A63B 2225/62; A63B 2220/803; A63B 71/06; A63B 41/00; A63B 2220/801; A63B 71/0672; A63G 31/14; A63G 31/12; A63G 31/007

USPC ..... 482/27; 463/7; 141/114

See application file for complete search history.

(56) References Cited

U.S. PATENT DOCUMENTS

| | | | | | |
|---|---|---|---|---|---|
| 3,698,374 | A | * | 10/1972 | Casper | 124/57 |
| 4,094,347 | A | * | 6/1978 | Ikemoto | 141/313 |
| 4,134,228 | A | * | 1/1979 | Ortiz | 446/225 |
| 4,243,220 | A | * | 1/1981 | Shelley | 273/458 |
| 4,248,008 | A | * | 2/1981 | Pitkanen | 446/187 |
| 4,412,568 | A | * | 11/1983 | Hughes | 141/392 |
| 5,370,161 | A | * | 12/1994 | Shafer | 141/114 |
| 5,588,896 | A | * | 12/1996 | Goodman | 446/187 |

(Continued)

*Primary Examiner* — Sandhara Ganesan

(74) *Attorney, Agent, or Firm* — Clement Cheng

(57) ABSTRACT

A nozzle assembly has a main body that is hollow. A hose connection is formed on the main body to receive a fluid. A stem extends away from the main body, and the stem is hollow. A tip is formed on an end of the stem, and the tip has a fluid outlet. An extension member extends away from the main body. A balloon retainer is connected to the extension member. The balloon retainer has an opening facing the fluid outlet. The balloon retainer is shaped so that inflation of a balloon to a greater inflation pulls a neck of the balloon off the stem to a released position so that the balloon flies off the stem.

17 Claims, 4 Drawing Sheets

(56) References Cited

U.S. PATENT DOCUMENTS

| | | | | |
|---|---|---|---|---|
| 5,603,361 | A * | 2/1997 | Cuisinier | 141/26 |
| 5,738,285 | A * | 4/1998 | Anderson | 239/654 |
| 6,149,488 | A * | 11/2000 | Stark | 446/220 |
| 7,147,016 | B1 * | 12/2006 | Nelson et al. | 141/114 |
| 8,251,111 | B2 * | 8/2012 | Nelson et al. | 141/361 |
| 8,307,612 | B1 * | 11/2012 | Sikorcin | 53/284.7 |
| 8,641,387 | B2 * | 2/2014 | Wang | 417/234 |
| 2005/0006523 | A1 * | 1/2005 | French et al. | 244/31 |
| 2006/0270525 | A1 * | 11/2006 | Colling | 482/27 |
| 2007/0004560 | A1 * | 1/2007 | Nelson | 482/29 |
| 2009/0050835 | A1 * | 2/2009 | Boise et al. | 251/320 |
| 2012/0067453 | A1 * | 3/2012 | Ramere et al. | 141/1 |
| 2012/0289120 | A1 * | 11/2012 | Nelson et al. | 446/224 |

* cited by examiner

NOZZLE ASSEMBLY

This application is a continuation in part of inventor Samuel Chen's United States patent application entitled balloon inflating trampoline U.S. Ser. No. 12/893,159 filed Sep. 29, 2010, the disclosure of which is incorporated herein by reference.

FIELD OF THE INVENTION

The present invention is in the field of nozzle assemblies.

DISCUSSION OF RELATED ART

Trampolines have been in use for decades as popular backyard entertainment, as well as for Olympic sport. Trampolines generally include a bounding surface, a plurality of springs connecting with the bounding surface to the trampoline frame. Additionally, a plurality of legs extends from the trampoline frame to support the trampoline frame above the ground. Trampolines also include auxiliary effects such as in Samuel Chen's lighted trampoline, described in U.S. Pat. No. 7,297,089 issued Nov. 20, 2007, the disclosure of which is incorporated herein by reference. Many of these auxiliary effects have been related to lighting or sound or a combination of the above. Auxiliary effects may include counters, timers and other electronic enhancements.

SUMMARY OF THE INVENTION

A nozzle assembly has a main body that is hollow. A hose connection is formed on the main body to receive a fluid. A stem extends away from the main body, and the stem is hollow. A tip is formed on an end of the stem, and the tip has a fluid outlet. An extension member extends away from the main body. A balloon retainer is connected to the extension member. The balloon retainer has an opening facing the fluid outlet. The balloon retainer is shaped so that inflation of a balloon to a greater inflation pulls a neck of the balloon off the stem to a released position so that the balloon flies off the stem.

Optionally, the nozzle assembly may further include a handle formed on the main body. A handle opening may be defined within the handle. A notch retainer can be disposed on the stem for retaining a neck of a balloon. The balloon retainer may have a first prong and a second prong formed on the balloon retainer with a retainer gap formed between the first prong and the second prong. The body may have a base formed on the main body, and the base is preferably wider than the main body.

Additionally, the nozzle assembly may be attached to a trampoline bed having a bounding surface, namely a trampoline bed bounding surface. The trampoline frame holds the bounding surface substantially horizontally to provide a jumping area for users. A balloon coupler formed as a nozzle assembly can be attached to the trampoline. A bounce module is mounted underneath the trampoline bed bounding surface. The bounce module is placed to receive motion from a user. The user activates a mode of the bounce module during jumping. A conduit hose is attached to the balloon coupler. A one-way valve is configured to regulate flow only to the balloon, and blocking any flow away from the balloon. A pump may pump water or air to the balloon. A balloon is attached to the balloon coupler so that the balloon is in fluid communication with the conduit hose.

A plurality of elastic cord attaches to the bounce module at a cord connection area and attaching to the trampoline frame. A trampoline mat fits over a plurality of springs. A plurality of legs formed on the trampoline frame, and supports the trampoline frame above the ground.

Figure 1:
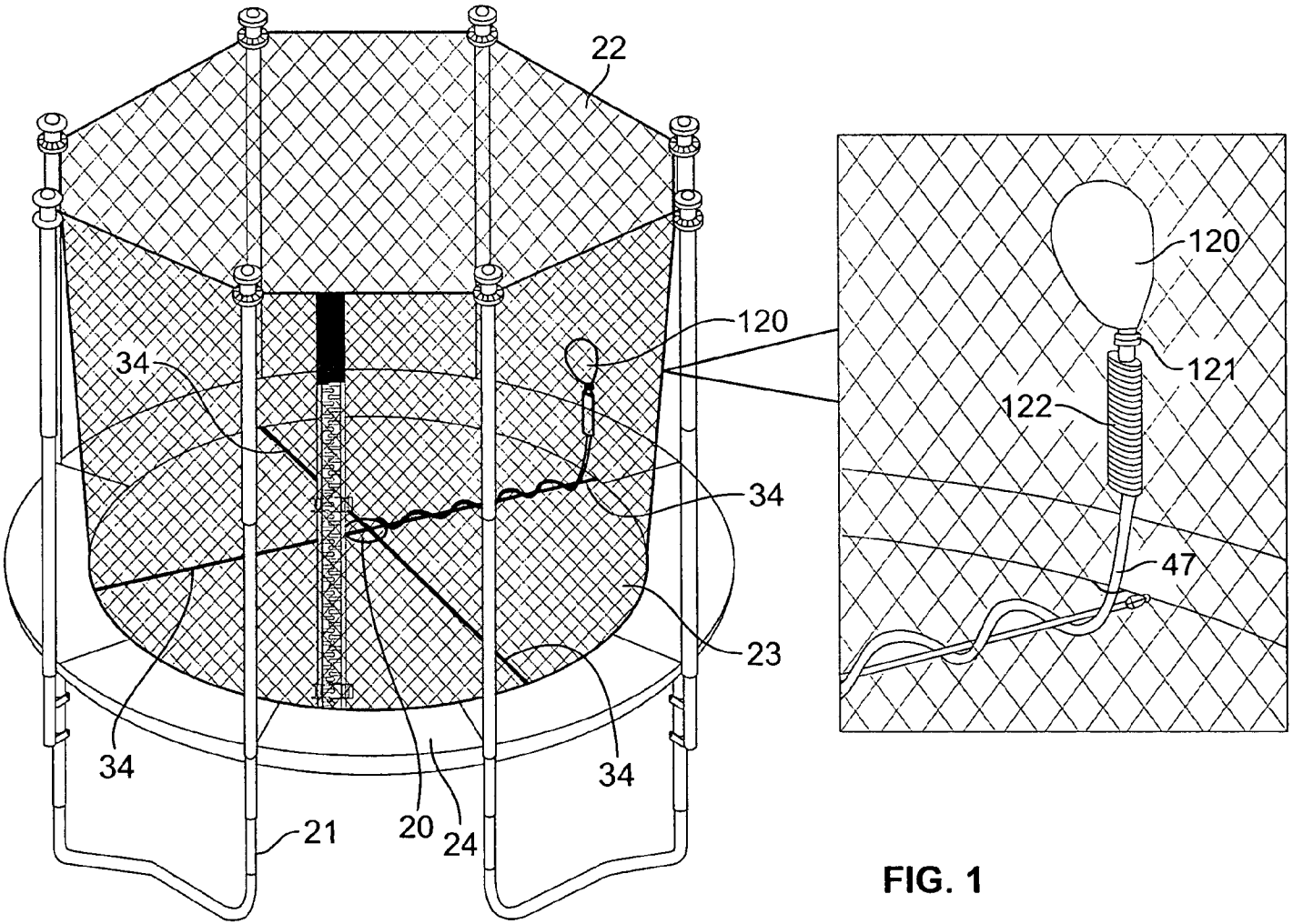
FIG. 1 is a perspective view of the balloon inflating trampoline.
Figure 2:
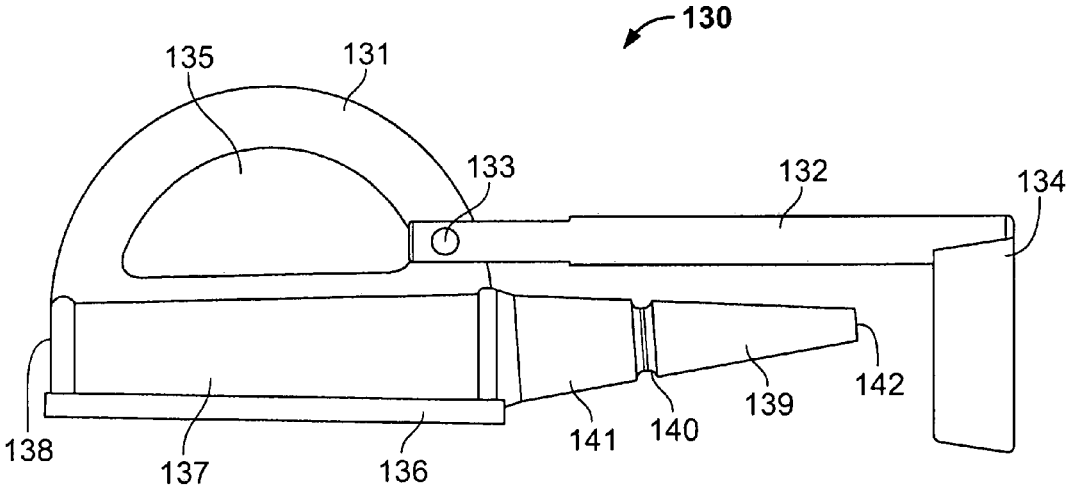
FIG. 2 is a side view of a nozzle assembly.
Figure 3:
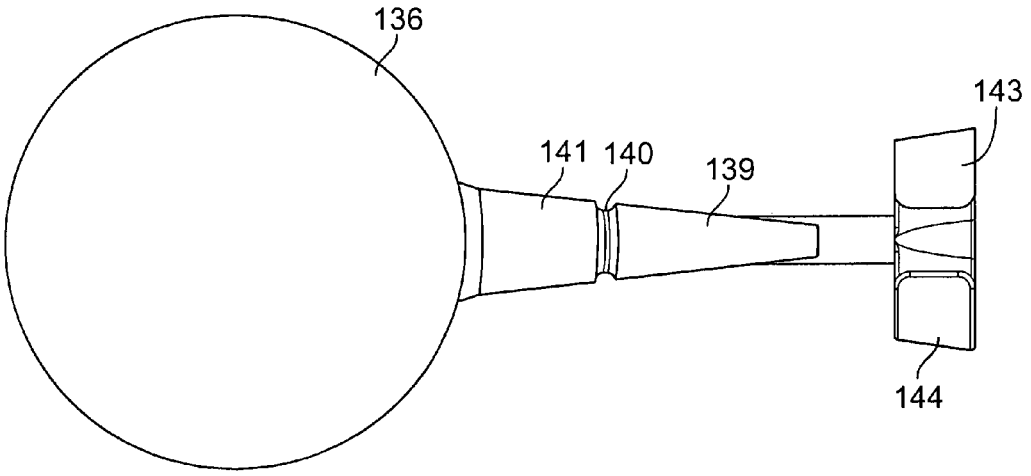
FIG. 3 is an outside view of the nozzle assembly.
Figure 4:
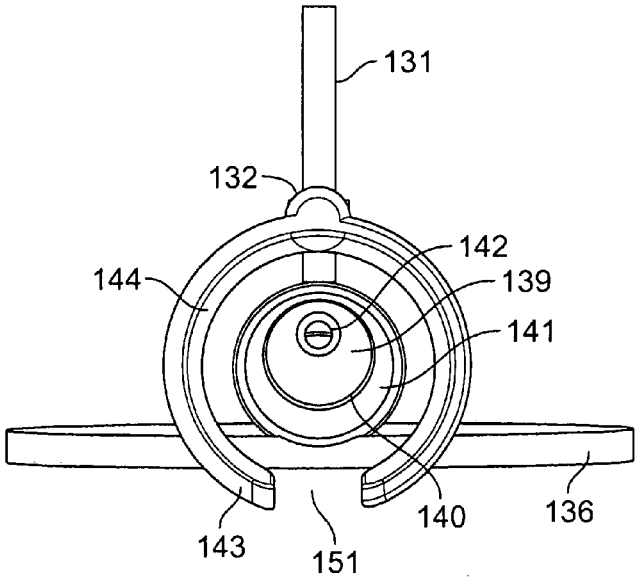
FIG. 4 is a top view of a nozzle assembly.
Figure 5:
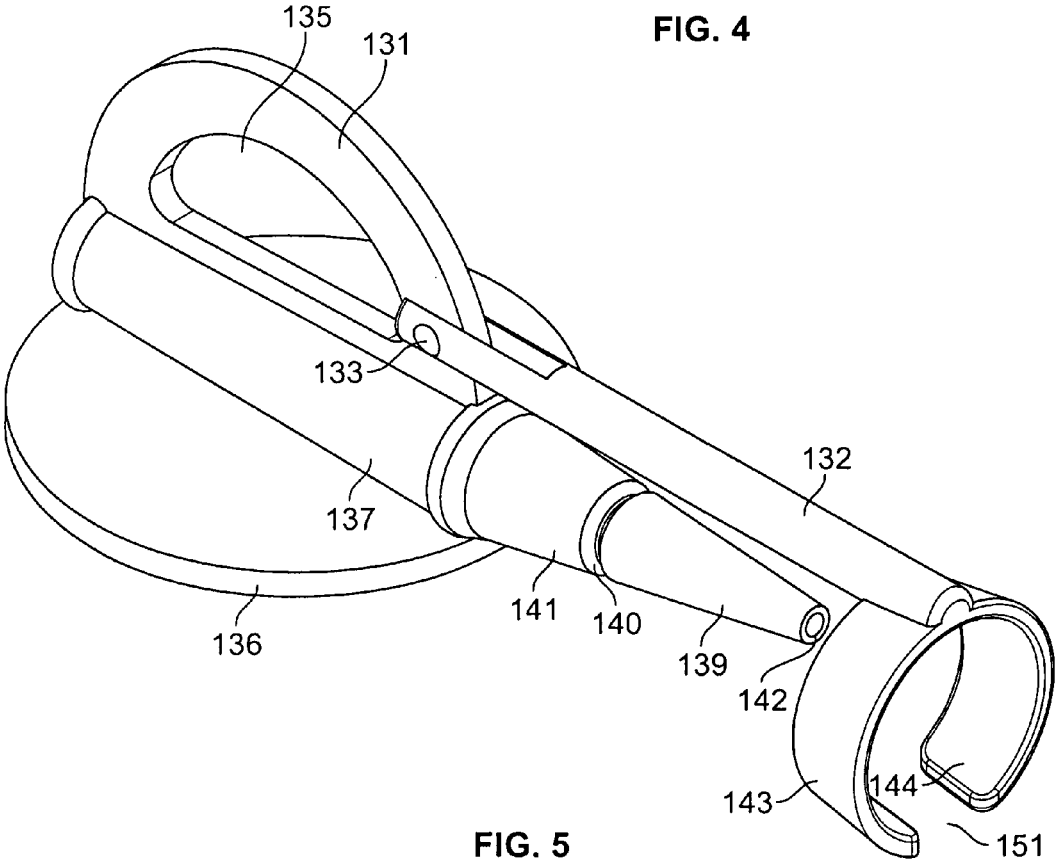
FIG. 5 is a perspective view of the nozzle assembly.

The following call out list of elements is used consistently in the drawings as follows:

120 Balloon
121 Balloon Coupler
122 Tube Sleeve
20 Bounce Module
21 Frame
23 Trampoline Bed
24 Trampoline Mat
34 Elastic Cord
47 Hose
130 Nozzle Assembly
131 Nozzle Handle
132 Extension
133 Hinge
134 Retainer
135 Opening
136 Base
137 Body
138 Hose Connection
139 Tip
140 Indent Retainer
141 Stem
142 Outlet
143 First Prong
144 Second Prong
151 Retainer Gap
152 Retainer Ring

DETAILED DESCRIPTION OF THE PREFERRED EMBODIMENT

The present invention is a nozzle assembly. The nozzle assembly can be implemented on a trampoline to provide a balloon inflating trampoline. The nozzle receives a balloon 120 that inflates when a user jumps on the trampoline bed which activates a flow of air to an air hose 47. The balloon 120 is connected to a balloon coupler 121. The balloon coupler is preferably shaped as a nozzle allowing a balloon to fit over the coupler. The nozzle may have a circumferential groove or indent around the periphery of the nozzle allowing a neck of the balloon to engage with the groove. The balloon coupler 121 may also include a clip to allow clipping of the neck of the balloon to the nozzle. When the balloon is clipped by the neck, the balloon may inflate until it bursts, and alternatively when the balloon is not clipped, the balloon may detach from the nozzle after the balloon reaches a certain size.

The tube sleeve 122 holds a vertical section of air hose 47 and can be clasped with hook and loop tape so as to allow release and attachment of the tube sleeve 122. The tube sleeve 122 is preferably a fabric tube having a pair of flaps that close over the air hose 47. The tube sleeve 122 is preferably mounted to the trampoline enclosure netting.

The tube sleeve can be formed as a nozzle assembly 130 of the present invention. The nozzle assembly may have a handle 131 with an opening 135. The handle is preferably attached to the body 137 and having a curved profile extending away from the body in a plane. The handle can be integrally formed with the body 137 of the nozzle assembly. The body is preferably mounted to or integrally formed with the base 136. The base 136 can have a circular profile such that it is a circular sheet of plastic having rounded edges. A hose connection 138 can be formed on the body so that the body receives water or air from the hose into a cavity within the body. The hose connection is formed close to the base and can be formed on the base.

A stem 141 extends from the body. The stem is tapered. The stem terminates in a tip 139. The tip terminates in an outlet 142 which receives water or air from the hose via the cavity which is fluidly connected to the hose connection. On the external surface of the stem, the tip has an indentation, namely the indent retainer 140. The indentation retainer 140 receives a neck of a balloon. The opening of the balloon fits over the tip and receives water or air from the outlet 142. The indentation retainer 140 is formed in a circumference around the stem. The stem may have a circular cross-section. The stem is preferably angled away from the base such that it is not parallel to the base. The stem can be made semi-rigid such as out of an elastomeric material.

A hinge 133 can be formed on the body to provide a hinge connection between an extension 132 and the body 137. The hinge 133 provides flexibility between the extension of the body. The hinge can be formed as a flexible portion of the extension or as a mechanical hinge having separate moving parts. One example of a maternal hinge as seen in the figures is a pin joint swivel were the pin extends through an opening in a flat portion of the handle. The hinge can be made as a spring such as a fiberglass leaf spring by forming the extension as a fiberglass shaft and then mounting the extension to the body.

Figure 6:
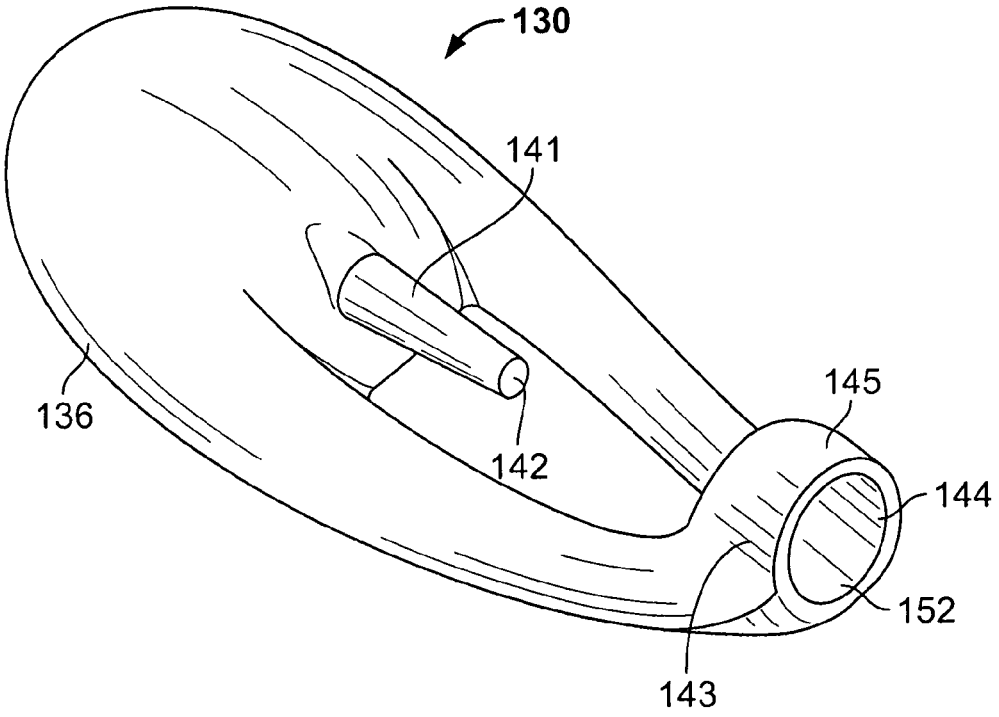
FIG. 6 is a perspective view of a second embodiment of the nozzle assembly.

The present invention has a pair of retainers. The first retainer retains the neck of the balloon in a notch and the second retainer retains the body of the balloon. The extension member terminates in a retainer 134 which is the balloon retainer. The retainer can be formed as a ring like molded plastic member having a first prong 143 in the second prong 144. The first prong can be on the right side and the second prong can be on the left side. The pair of prongs are curved in a circular shape to match the profile of a round balloon. The pair of prongs preferably do not meet such that there is a retainer gap 151 formed between the first prong 143 and the second prong 144 as seen in FIGS. 2-5. Alternatively, the extension member can be formed as a pair of arms that terminate in a completely circular retainer having no gap called a retainer ring 152, as seen in FIG. 6.

To use the device, a user puts a balloon on the tip with the neck of the balloon lodged to the indentation retainer. The main portion of the balloon fits through the retainer so that the inflation of the balloon pulls the neck away from the tip with the result that a balloon filled with air would fly away in an uncontrolled manner. The retainer has a balloon pushing surface facing the main air chamber of the balloon. As a balloon filled with air, the tension on the neck becomes greater until the balloon neck is pulled away.

Although the nozzle assembly could be implemented on a wide variety of different balloon inflating apparatus such as inflatable bounce houses, inflatable water slides, and other inflatable backyard fun equipment, the following discusses implementation of the nozzle assembly on a trampoline. The trampoline enclosure is typically a net having an entrance. The entrance can be secured by a zipper. The trampoline also has a trampoline mat extending around a circumferential area of the bounding surface. The trampoline mat covers the springs which are not accessible by a user within the jumping area, because the jumping area is limited to the area above bounding surface. A plurality of legs extend from the support pole. The legs can be U-shaped and formed in sections, namely a first leg section, a second leg section and a bottom section that is also called a leg connection member. The leg connection member connects to the leg first section at a leg connection interface and connects to the leg second section at a leg connection interface. The first leg section is the leg section that connects to the support pole. The second leg section connects to the trampoline frame.

The trampoline frame 21 supports the mat 24 and the bed bounding surface 23, and the springs extending between the bounding surface and the mat. The springs are hidden under the mat 23. When in use, a user exerts force on the structure. A neutral force position can be defined when a user is absent and the structure is not in use. During use, a user jumps up and down on the bounding surface. The bounding surface extends inward and creates moment and exerts force on the trampoline structure.

The bounce module 20 is connected by a plurality of elastic cord 34. The bounce module has preferably a laminate construction including a top cord attachment area flange with an opening for connecting the elastic cord. The laminate construction may include a top cover. The bounce module may also include a reflector that is plastic molded and has a reflective surface including a reflector post. Optionally, a plurality of reflector ribs can be introduced on the surface of the reflector for the purpose of adding an extra angle of viewing for a viewer. The bounce module is preferably substantially rigid and having a disk shape. The trampoline mat is immediately above the module so that when users jump on the trampoline mat, the module moves up and down. The module is suspended by preferably a total of four elastic cord the elastic cord connect to an elastic cord attachment area which then connect to a frame of the trampoline. The module can be suspended by attachment to a frame of the trampoline assembly.

It is an optional feature to have an inflatable bag resting on the ground and underneath the module so that the inflatable bag is pressed upon when users jump up and down on the trampoline mat. The inflatable bag can be kept inflated by an air pump. Fluctuations in the inflatable air bag push air through one-way valves located on the air tube line. The inflatable bag can be inflated by the air pump on the module, or by a separate air pump. The inflatable bag is essentially another balloon that has an air intake and air output such that the inflatable bag operates as an air pump. When the users jump on the air pump, the motion of the users is translated into pumping up the balloons. The balloons can be pumped up either until they pop or until they fly off. The inflatable air bag can be formed as a bellows structure or as a round balloon. When the pump is continuously inflating the inflatable bag, the pump is preferably not connected to the control circuitry, but is preferred to be in continuous operation. The pump could be activated only when motion is sensed, but continuous operation is favored.

The inflatable bag may have a circular base with cylindrical shaped sidewalls. The inflatable bag can be a mechanical pump. The inflatable bag may also have a bellows like, accordion shaped sidewalls so that it can be a mechanical pump. The structure of the bellows pump can be restored by elastic cord or spring to draw in more air to the bellows pump. The base of the inflatable bag preferably sits on the ground surface underneath the trampoline. The inflatable bag can be inflated so that it is wedged between the ground and the module. The module provides light as well as a flat surface for a abutting the inflatable bag. The inflatable bag may have a cylindrical configuration with a circular top, a circular bottom and cylindrical shaped sidewalls. The circular top and circular bottom are preferably sealed to the cylindrical shaped sidewalls. The bounce module can be integrally formed as a top surface of the bellows structure which abuts the bellow to engage the bellows.

The pump can also pump water through the water hose for the purpose of filling up water balloons, which could fall off of the coupler or explode when filled beyond capacity. The pump is in fluid communication with the hose and a balloon. The fluid can be water or air. It is preferred that approximately 20 bounces are required to fill a balloon halfway full, and for approximately 40 bounces required to fill a balloon and more than that to pop a balloon.

A variety of minor modifications to the design can be made without departing from the scope of the claims, such as by connecting multiple nozzle assemblies to a trampoline or inflatable jumper.

The invention claimed is:

1. A nozzle assembly comprising:

a. a main body, wherein the main body is hollow;

b. a hose connection formed on the main body to receive a fluid;

c. a stem extending away from the main body, wherein the stem is hollow;

d. a tip formed on an end of the stem, wherein the tip has a fluid outlet;

e. an extension member extending away from the main body;

f. a balloon retainer connected to the extension member, wherein the balloon retainer has an opening facing the fluid outlet, wherein the balloon retainer is shaped so that inflation of a balloon to a greater inflation pulls a neck of the balloon off the stem to a released position, without clamping the neck of the balloon, wherein the balloon retainer engages a balloon external surface, without bursting the balloon, so that the balloon flies off the stem, wherein the retainer is configured so that the balloon including a bead end of the balloon fits all the way through the retainer opening of the retainer so that tension on the neck becomes greater until the neck is pulled away from the stem.

2. The nozzle assembly of claim 1, further comprising:

a. a handle formed on the main body.

3. The nozzle assembly of claim 2 further comprising:

a. a handle opening defined within the handle.

4. The nozzle assembly of claim 1, further comprising:

a. a notch retainer disposed on the stem for retaining a neck of a balloon.

5. The nozzle assembly of claim 1, wherein the balloon retainer:

a. a first prong and a second prong formed on the balloon retainer with a retainer gap formed between the first prong and the second prong.

6. The nozzle assembly of claim 1, further comprising:

a. a base formed on the main body, wherein the base is wider than the main body.

7. The nozzle assembly of claim 6, further comprising:

a. a handle formed on the main body.

8. The nozzle assembly of claim 7, further comprising:

a. a handle opening defined within the handle.

9. The nozzle assembly of claim 6, further comprising:

a. a notch retainer disposed on the stem for retaining a neck of a balloon.

10. The nozzle assembly of claim 6, further comprising:

a. a first prong and a second prong formed on the balloon retainer with a retainer gap formed between the first prong and the second prong.

11. The nozzle assembly of claim 6, further comprising:

a. a trampoline bed having a bounding surface, namely a trampoline bed bounding surface;

b. a trampoline frame holding the bounding surface substantially horizontally to provide a jumping area for users.

12. The nozzle assembly of claim 11, further comprising:

a. a handle formed on the main body.

13. The nozzle assembly of claim 12, further comprising:

a. a handle opening defined within the handle.

14. The nozzle assembly of claim 11, further comprising:

a. a notch retainer disposed on the stem for retaining a neck of a balloon.

15. The nozzle assembly of claim 11, further comprising:

a. a first prong and a second prong formed on the balloon retainer with a retainer gap formed between the first prong and the second prong.

16. The nozzle assembly of claim 11, further comprising:

a. a first prong and a second prong formed on the balloon retainer.

17. A nozzle assembly comprising:

a. a trampoline bed having a bounding surface, namely a trampoline bed bounding surface;

b. a trampoline frame holding the bounding surface substantially horizontally to provide a jumping area for users; and c. a main body attached to the trampoline frame, having a hose connection formed on the main body to receive a fluid;

d. a stem extending away from the main body, wherein the stem is hollow;

e. a tip formed on an end of the stem, wherein the tip has a fluid outlet;

f. an extension member extending away from the main body;

g. a balloon retainer connected to the extension member, wherein the balloon retainer has an opening facing the fluid outlet, wherein the balloon retainer is shaped so that inflation of a balloon to a greater inflation pulls a neck of the balloon off the stem to a released position, without clamping the neck of the balloon, wherein the balloon retainer engages a balloon external surface, without bursting the balloon, so that the balloon flies off the stem.

* * * * *